United States Patent [19]

Hudec et al.

[11] 4,149,979

[45] Apr. 17, 1979

[54] CONDITIONING AND WATER-REPELLENT AGENTS FOR CELLULOSE-CONTAINING TEXTILES AND LEATHER

[75] Inventors: Gustav Hudec, Schwalbach; Karl-Heinz Keil, Offenbach; Volker Köhler, Niedernhausen; Joachim Ribka, Offenbach; Kurt Rosenbusch, Frankfurt am Main, all of Fed. Rep. of Germany

[73] Assignee: Cassella Aktiengesellschaft, Frankfurt, Fed. Rep. of Germany

[21] Appl. No.: 919,436

[22] Filed: Jun. 26, 1978

[30] Foreign Application Priority Data

Jul. 2, 1977 [DE] Fed. Rep. of Germany ..... 2730042

[51] Int. Cl.[2] ..... D06M 13/40; C07C 143/74

[52] U.S. Cl. ..... 252/8.75; 252/8.9; 260/401; 260/553 D

[58] Field of Search ..... 252/8.75, 8.9; 260/401, 260/553 D, 556 F, 556 A

[56] References Cited

U.S. PATENT DOCUMENTS

| | | | |
|---|---|---|---|
| 2,487,383 | 11/1949 | Sallmann | 260/401 X |
| 2,976,317 | 3/1961 | Ruschig et al. | 260/553 D |
| 3,069,466 | 12/1962 | Pantlitschko | 260/553 D |
| 3,558,677 | 1/1971 | Sweeney et al. | 260/401 |
| 3,595,886 | 7/1971 | Sweeney et al. | 260/401 |
| 3,642,908 | 2/1972 | Burness et al. | 260/553 D X |
| 3,864,396 | 2/1975 | Staffe et al. | 252/8.75 X |
| 3,965,015 | 6/1976 | Bauman | 252/8.75 X |

FOREIGN PATENT DOCUMENTS

| | | | |
|---|---|---|---|
| 2153270 | 5/1973 | Fed. Rep. of Germany | 260/556 F |
| 1231952 | 5/1971 | United Kingdom | 260/553 D |

*Primary Examiner*—Thomas Waltz

*Attorney, Agent, or Firm*—Connolly and Hutz

[57] ABSTRACT

Conditioning and water-repellent compositions containing agents for cellulose-containing textiles or leather comprising sulphonylureas of the formula

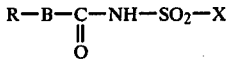

wherein R is alkyl or alkenyl having 10–30 carbon atoms; B is a member selected from the group comprising

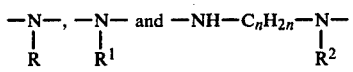

wherein $R^1$ is alkyl having 1–4 carbon atoms, $R^2$ is hydrogen or alkyl having 1–4 carbon atoms and n is 2, 3 or 4;

and X is β-halogenoalkyl or alkenyl with 2 to 4 carbon atoms each. Also disclosed are novel sulphonylureas per se and a method of use for sulphonylureas as conditioning and water repellent compositions.

16 Claims, No Drawings

CONDITIONING AND WATER-REPELLENT AGENTS FOR CELLULOSE-CONTAINING TEXTILES AND LEATHER

The present invention relates to conditioning and water-repellent textile materials consisting of or containing cellulose and for leather, consisting of a parts by weight of a compound of the general formula I,

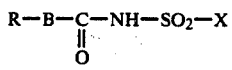

(I)

in which

R signifies alkyl or alkenyl with 10 to 30 carbon atoms,

B is one of the divalent radicals

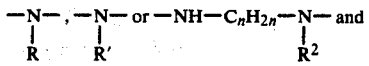

X is β-halogenoalkyl or alkenyl with 2 to 4 carbon atoms each, $R^1$ and $R^2$ signify hydrogen or alkyl with 1 to 4 carbon atoms and also n signifies 2, 3 or 4 and b parts by weight of an emulsifier consisting of 100 to 37.5% of known non-ionic emulsifiers, 0 to 50% of known anionic emulsifiers and 0 to 25% of known fat liquors, c parts by weight of an epoxide of the formula II

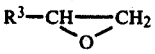

(II)

in which $R^3$ signifies alkyl or alkenyl with 15 to 40 carbon atoms, and possibly d parts by weight of water or of an organic solvent which is miscible with water, in which a has a value of 80 to 99, b has a value of 20 to 1, c has a value of 0 to 5 and possibly $$(100 \cdot a)/(a+b+c+d)$$

has a value of 10 to 40, the production and use of these agents and also the new active principles of the formula I and their production.

Conditioning agents are intended to impart to textile materials and leather advantageous surface properties, especially a pleasant warm feel. In addition, conditioning agents can improve the processing properties of fibre materials. Known conditioning agents are, for example, natural oils and partially saponified natural fats.

These products impart to the textile materials a full, soft but somewhat dull feel. A special disadvantage is their sensitivity to hardness in water and their tendency to become rancid. More insensitive to hardness of water are conditioning agents on the basis of sulphated oils or fats. Further known conditioning agents are, for example, primary alkylsulphates, such as cetyl and stearyl sulphate. In addition to the anionic conditioning agents there are also known cationic conditioning agents on the basis of quaternary ammonium bases with at least one long-chained alkyl radical, such as have been described, for example, in Swiss Patent Specification No. 130,881 or German Patent No. 546,406. The cationic conditioning agents give, it is true, a pleasant soft feel, but tend at high temperatures to go yellow. Furthermore, under certain circumstances they lead to colour changes and reduce the fastness to light of dyestuffs. A certain improvement in regard to the tendency towards yellowing with the influencing of the fastness to light of dyeing was provided by the conditioning agents described in U.S. Pat. No. 2,304,369 and in German Federal Patent No. 1,048,412 and containing mainly carboxylamide or urea groupings.

In addition to the conditioning effect it is frequently desired to bring about a water-repellent effect of the textile material or the leather. Known possibilities for water-repellent textile materials and leather are the treatment with solutions or emulsions of paraffinic hydrocarbons, waxes or the like. Also metallic soaps have already been used for water-repellent purposes. Combinations of metallic salts and paraffin and wax emulsions which can be considered for water-repellent purposes are knwon from German Pat. No. 702,628 and from U.S. Pat. No. 2,015,864. Metallic complexes which, in a similar manner to metal soaps, can be used for water-repellent purposes, are known from U.S. Pat. No. 2,272,040.

A disadvantage of all the abovementioned conditioning agents and water-repellents is the fact that they are not sufficiently fast to wetness and washing. It has, therefore, already been attempted to bring about water-repellency by chemical reaction with the cellulose. Thus, it is known from German Patent 542,186 that cellulose materials can be treated with anhydrides or chlorides of fatty acids. However, it has not been possible for this process to be introduced in practice. From U.S. Pat. No. 2,173,029 the water repellency of the cellulose materials with long-chained isocyanates, for example stearyl isocyanate is known. However, this process has the disadvantage that the water proofing has to be carried out in the organic solvent. Certain improvements of this process by the use of isocyanate adducts are known from British Patent Specification No. 716,232 and U.S. Pat. No. 2,746,988. Further known water-repellents are alkoxymethyl-pyridinium compounds with a long-chained alkoxy radical (German Patent No. 613,735) and the similarly built-up N-alkanoylaminomethyl-pyridinium chlorides (British Patent No. 466,817) with a long chained alkanoyl radical, and also in particular the N-alkyl-N-ethyleneureas with a long-chained alkyl radical known from German Patent No. 681,520.

However, the known products display a number of disadvantages, such as for example their lack of resistance to water and, connected with this, a fall in their reactivity when stored for a fairly long time, a not always sufficient water-repellent effect, the need for carrying out the chemical bonding between the water-repellents and the cellulose fibre by heating to temperatures of 120° to 150° C. The fibre-reactive water-repellents known from German Pat. No. 681,520 provide, it is true, good water-repellent effects, but still leave much to be desired regarding durability, because under the action of light, heat or traces of acid, they tend towards autopolymerisation with a weakening of their action. Furthermore their production gives rise to considerable problems from the point of view of apparatus.

Further disadvantages of known products are, for example, a lack of compatibility with other finishing agents for textiles and/or leather or with acid dyestuffs, which can lead to alterations in the shade of dyes, an action which is not uniformly good in different materials, such as for example vegetable-tanned or chrome-tanned leather, lack of resistance of the water-repellent and conditioning effects to dry-cleaning and greasiness when applied to velvet leather.

The present invention now relates to conditioning agents and water-repellents which give an excellent improvement in the handle of cellulose textile materials and leather whilst at the same time providing outstanding water-repellent effects. The effects achieved show a very good resistance to wetting, washing and dry-cleaning and they can be achieved on different cellulose materials and very different qualities of leather. Furthermore, the substratum reactive active principles of formula I contained in the conditioning agents and water-repellents to be used according to the invention can be produced in a technically simple manner.

The conditioning agents and water-repellents for textile materials consisting of or containing cellulose and for leather to be used according to the invention consist of a parts by weight of a compound of the general formula I

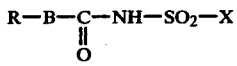

(I)

in which R signifies alkyl or alkenyl with 10 to 30 carbon atoms, B is one of the divalent radicals

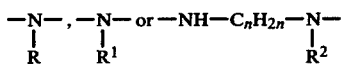

X is β-halogenoalkyl or alkenyl with 2 to 4 carbon atoms each, $R^1$ and $R^2$ signify hydrogen or alkyl with 1 to 4 carbon atoms and also n signifies 2, 3 or 4, and b parts by weight of an emulsifer consisting of 100 to 37.5% of known non-ionic emulsifers, 0 to 50% of known anionic emulsifiers and 0 to 25% of known fat-liquors, c parts by weight of an epoxide of the formula II

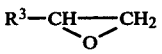

(II)

in which $R^3$ signifies alkyl or alkenyl with 15 to 40 carbon atoms, and possibly d parts by weight of water or of an organic solvent which is miscible with water, in which a has a value of 80 to 99, b has a value of 20 to 1, c has a value of 0 to 5 and possibly $$(100 \cdot a)/(a+b+c+d)$$

has a value of 10 to 40.

Particularly favourable properties are possessed by auxiliary materials according to the invention with 95 to 99 parts by weight of the active principle of formula I and 1 to 5 parts by weight of the emulsifier in 100 parts by weight of the auxiliary material.

The long-chained alkyl radicals R of the active principles of formula I with 10 to 30 carbon atoms contained in the auxiliary preparations according to the invention are preferably only slightly branched or straight.

Preferred active principles of the formula I have alkyl radicals R with 12 to 22 carbon atoms. Examples of alkyl radicals which can occur for R in the active principles of the formula I are: Decyl, undecyl, duodecyl, 8-ethyldecyl(10), tridecyl, tetradecyl, pentadecyl, hexadecyl, heptadecyl, octadecyl, 6-hexyl-duodecyl(12), monadecyl, eicosyl, heneicosyl, docosyl, tricosyl, tetracosyl, pentacosyl, hexacosyl, heptacosyl, octocosyl, triacontyl.

In the β-halogeno-alkyl radical standing for X the halogen, for example, signifies bromine, iodine, in particular, chlorine. Examples of the β-halogenoalkyl radical are in particular β-chloroethyl, β-chloropropyl and β-chlorobutyl. Examples of the alkenyl standing for X are vinyl, propenyl, 1-butenyl and 2-butenyl.

Both from the point of view of the effect, emulsifiability and technical properties in regard to their use, and also for reasons of easy accessibility of the corresponding initial materials such mixtures of compounds of the formula I according to the invention are also preferred in which the radicals R in regard to their number of carbon atoms and their molar proportion in the mixture correspond to the statistical composition of the carboxylic acids in natural fats, such as tallow, coconut oil, stearine, soya bean oil or palm oil. Radicals R which signify such a group of alkyl radicals are usually designated as tallow alkyl, coconut oil alkyl etc. Thus, for example, "stearyl alkyl" consists in the main of alkyl radicals with 16 to 18 carbon atoms, "tallow alkyl" consists in the main of alkyl radicals with 14, 16, 18 carbon atoms and the octadecen-(9)-yl-(1) radical and "oleyl-alkyl" consists of alkyl radicals with 16 to 18 carbon atoms and the octadecen-(9)-yl-(1) radical.

A further group of preferred active principles of the formula I are those in which B signifies one of the divalent radicals

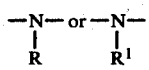

Because of their particularly advantageous reactivity and favourable accessibility such active principles of the formula I are also preferred in which X signifies a β-chloroalkyl group with 2 to 4 carbon atoms, such as the β-chloroethyl-, β-chloropropyl- or β-chlorobutyl group.

The active principles of formula I to be used according to the invention behave particularly favourably in regard to their joint use with other agents necessary for the treatment or improvement of textiles or leather and with regard to their emulsifiability in aqueous liquors. This advantageous property of the active principles contained in the conditioning agents and water-repellents according to the invention opens up the possibility of varying in many different ways the emulsifier which is necessary for the emulsification of the active principle in water and in this way producing means which can find a special application either for textiles or for leather, or even auxiliary agents which can be used universally both for cellulose textiles and for leather.

It is also quite advantageous to utilise this possibility and to adapt the emulsifier contained in the conditioning agents and water-repellents according to the invention to any main application of the agent which is in mind. In any case the emulsifier contains a proportion of known nonionogenic emulsifers which are comprised under the general formula III $$A-(OCH_2-\underset{\underset{R^4}{|}}{CH})_n-OH \quad (III)$$

in which

A signifies branched or straight or alkenyl with 10 to 22 carbon atoms, alkylphenyl with a total of 6 to 12 carbon atoms in the alkyl radical, branched or unbranched alkanoyl or alkenoyl with 10 to 22 carbon atoms, aralkyl with 7 to 15 carbon atoms, aralkylaryl with 13 to 25 carbon atoms, radicals of the wool grease components or acyloxyalkyl with a total of 10 to 30 carbon atoms;

$R^4$ signifies hydrogen or alkyl with 1 to 2 carbon atoms and n signifies a number between 10 and 60.

Non-ionic emulsifiers of the general formula III given above are obtained by reacting compounds containing hydroxyl groups AOH with alkylene oxides such as butylene, propylene and preferably ethylene oxide. Conditioning and water-repellent preparations according to the invention in which there are ethylene oxide reaction products with 10 to 30 moles of ethylene oxide as the non-ionogenic emulsifiers give particularly stable emulsions.

Organic compounds AOH containing hydroxyl groups which are suitable for the manufacture of the non-ionogenic emulsifiers contained in the auxiliary preparations according to the invention are for example long-chained alkanols and alkenols with 10 to 22 carbon atoms, especially those which are derived from the natural fatty acids such as stearic acid, palmitic acid, oleic acid or the natural fatty acid mixtures such as those which occur in coconut oil fatty acid or tallow fatty acid; carboxylic acid with 10 to 22 carbon atoms, especially here again the natural fatty acids such as stearic acid, palmitic acid, oleic acid or naturally occurring fatty acid mixtures such as coconut oil fatty acid or tallow fatty acid; Alkylphenols with 4 to 9 carbon atoms in the alkyl radicals, such as for example p-t-butylphenol, p-nonylphenol, tri-isopropyl and tri-isobutylphenols, for example 2,4,6-tri-(n)-butylphenol, 2,4,6-tri-isobutylphenol or 2,4,6-tri-tert.-butylphenol;

Aralkanols, especially phenyl and diphenyl alkanols such as for example benzyl alcohol, β-phenylethanol, β-(4-methylphenyl)-ethanol, β-(4-isopropylphenyl)-ethanol, 4'-methyl-4-β-hydroxyethyldiphenyl;

Hydroxyaralkyl aryls, especially aralkylated phenols and hydroxy-diphenyls, such as for example 4-hydroxy-diphenylmethane, 4-hydroxy-4'-dimethylphenylmethane, 2-hydroxy-4'-methyldiphenylmethane, 4-benzyl-2'-hydroxydiphenyl or 2-benzyl-2'-hydroxydiphenyl, 4-(p-tolyl)-4'-hydroxydiphenyl; polyhydric alcohols partially esterified with long-chained fatty acids, such as for example fatty acid monoglycerides and diglycerides, fatty acid esters of sorbitol and sorbitan, the fatty acid component being in particular the natural fatty acids such as lauric acid, palmitic acid, stearic acid, oleic acid or naturally occurring fatty acid mixtures, such as coconut oil fatty acid or tallow fatty acid;

The wool grease components, such as palmitic acid, cerotic acid, caproic acid, oleic acid, lanoceric acid, myristic acid, lanopalmitic acid, cholesterin, lanosterin, agnosterin, cetyl alcohol, ceryl alcohol, which are advantageously used in the form of natural lanolin.

For use in the auxiliary preparations according to the invention the reaction products of lanolin with 10 to 30 moles of ethylene oxide are particularly valuable bacause they give especially stable emulsions or dispersions of the auxiliaries according to the invention in aqueous treatment liquors.

Auxiliary preparations according to the invention which are intended preferably for use in textiles contain in the main preferably 100% non-ionic emulsifiers. Auxiliary preparations according to the invention which are intended specially for use in the leather sector contain no epoxides of the formula II, but instead up to 50% of the non-ionic emulsifier can be replaced by anionic emulsifiers. In the conditioning and water-repellent preparations according to the invention it is possible for the emulsifier to be composed of 100 to 50% of non-ionic emulsifiers and 0 to 50% of anionic emulsifiers. Known emulsifiers used in the technical processes of leather dressing are for example sulphated fats or oils, such as for example sulphated fish oil or sulphated sperm oil, palm oil or neatsfoot oil, sulphonated or sulphated paraffinic hydrocarbons, chloroparaffinic hydrocarbons, olefins, fatty alcohols with a chain length 10 to 30 carbon atoms, their salts and their chemically modified derivatives on the sulpho group, such as sulphotaurides, sulphoamides or imides, sulpho-esters, chemically modified fatty acids with 10 to 50 carbon atoms, such as for example fatty acid taurides, fatty acids oxethanesulphonates, alkylarylsulphonic acid or its salts with an alkyl radical with 5 to 30 carbon atoms.

It is also possible with the auxiliary preparations according to the invention to carry out at the same time as the conditioning and water repellency of the leather, the greasing of the leather with a fatliquor. In this case it is also possible to incorporate directly into the auxiliary preparations according to the invention at least a part of the fatliquor necessary for fatting the leather. This fatliquor portion usually replaces a part of the emulsifiers contained in the auxiliary preparations to be used according to the invention. It is quite possible to replace up to 25 percent by weight of the emulsifier with fatliquor. In such a conditioning and water-repellent agent according to the invention containing fatliquor and intended for the leather sector the emulsifier accordingly consists of 95.0 to 37.5 percent by weight of known non-ionic emulsifiers, 0 to 50 percent by weight of known anionic emulsifiers and 5 to 25 percent by weight of known fatliquors. Preferably, the emulsifier of the auxiliaries according to the invention intended for use in leather contains from 90 to 60 percent by weight of known non-ionic emulsifiers, 0 to 20 percent by weight of known anionic emulsifiers and 10 to 20 percent by weight of known fatliquors.

From the known fatliquors described, for example, in "Ullmanns Enzyklopädie der technischen Chemie," Vol. 11, p. 567, it is possible to incorporate into the conditioning agents and water-repellents according to the invention the products within the framework of the above statements which are free from cationic substances built up on the basis of anion-active components.

In the case of the fatliquors one draws a distinction between the classic fatliquor systems which are built up of emulsifiers, neutral oils, neutral fats and buffer systems, and the synthetic and semi-synthetic liquor systems.

The classic fatliquors include fatteners on a vegetable and animal basis, such as for example tallow, fish oil, sperm oil, neat's foot oil, castor oil, olive oil, linseed oil, stearine, wool grease, waxes such as bees wax, Carnauba wax or Montan wax as well as mineral oil and straight chloroparaffins with 18 to 30 carbon atoms and 10 to 50 percent by weight of chlorine in the chain. In order to be able to use these classic fatteners as fat-liquors, there are two possibilities offered, namely the production of sulphonated semisynthetic easily emulsifiable systems by partial reaction with monohydrate for sulphuric acid, or else by means of emulsifiers or emulsifier mixtures in the form of non-ionic or preferably anionic compounds to convert them into an emulsified form. However, today, increasing use is being made of synthetic products for the fatliquoring of leather, which possess emulsifier properties and at the same time have a fatliquoring effect.

Examples of groups of synthetic compounds which can be contained in the conditioning agents and water-repellents according to the invention partly in combination with the abovementioned water-insoluble natural and synthetic fatting agents and partly by themselves as fatliquors, are:

Fatty acid esters of $\beta$-hydroxyethanesulphonic acid such as for example $$CH_3-(CH_2)_{16}-CO-O-CH_2-CH_2-SO_3^{\ominus}Na^{\oplus}$$

and $$CH_3-(CH_2)_7-CH=CH-(CH_2)_7-CO-O-CH_2-CH_2-SO_3^{\ominus}Na^{\oplus};$$

Fatty acid derivatives of amino-acetic acid, such as for example $$CH_3-(CH_2)_{16}-CO-NH-CH_2-COO^{\ominus}Na^{\oplus};$$

Fatty acid taurides and fatty acid N-methyltaurides such as for example $$CH_3-(CH_2)_7-CH=CH-(CH_2)_7-CO-\underset{\underset{CH_3}{|}}{N}-CH_2-SO_3^{\ominus}Na^{\oplus};$$

Synthetic sulphochlorination products, such as for example $$CH_3-CH_2-\underset{\underset{SO_2Cl}{|}}{CH}-CH_2-CH_2-\underset{\underset{SO_2Cl}{|}}{CH}-(CH_2)_6-CH_3;$$

Secondary sulphonate alkali salts, such as for example $$CH_3-CH_2-\underset{\underset{SO_3Na}{|}}{CH}-(CH_2)_9-CH_3;$$

long-chained sulphamides, such as for example $$CH_3-CH_2-\underset{\underset{SO_2-\underset{\underset{CH_3}{|}}{N}-CH_2-CH_2-SO_3^{\ominus}Na^{\oplus};}{|}}{CH}-(CH_2)_{12}-CH_3$$

Sulphoxidation products of mainly saturated unbranched paraffins, such as for example $$C_{18}H_{37}-SO_3Na$$

$$C_{18}H_{37}-SO_2-NH-CH_2-COO^{\ominus}Na^{\oplus} \text{ or}$$

$$C_{18}H_{37}-SO_2-\underset{\underset{CH_3}{|}}{N}-CH_2-CH_2-SO_3^{\ominus}Na^{\oplus};$$

Alkyl-aryl sulphonates and olefin sulphonates.

The good compatibility of the active principles of the formula I contained in the auxiliaries according to the invention also make it possible to use them together with epoxides of the formula II. This is of particular interest if the agents according to the invention are used for textiles, that is to say for the conditioning and water-repellency of textile materials containing cellulose or consisting of cellulose. Agents intended for this special application contain 0.5 to 5 parts by weight of the epoxides of formula II per 100 parts by weight of the auxiliary preparation. By means of this addition one achieves, surprisingly, a substantial increase in the effect of the preparations according to the invention in regard to the desired improvement in handle and the water-repellency of the treated textile material.

In order to facilitate the use, handling and dosing of the auxiliary preparations according to the invention it is advantageous to add to the mixtures of active principles of formula I according to the invention, emulsifier and possible epoxides of the formula II, enough additional water or organic solvent which is miscible with water for the resulting products to have a content of 10 to 40 percent by weight in regard to the active principle of formula I, that is to say if the fraction $$100 \cdot a/a+b+c+d$$

has a value of 10 to 40.

The weight of the water to be added or of the organic solvent miscible with water, accordingly, depends on the quantities a,b,c, of the other components of the preparation and is found from the above equation to be $$d = 100 \cdot a/(10 \text{ to } 40) = (a+b+c).$$

Organic solvents which are miscible with water and which can be contained in the auxiliary preparations according to the invention are lower alkanols, such as for example methanol, ethanol, propanol, isopropanol; ketones such as acetone, diethylketone, methylethylketone; cyclic ethers, such as for example tetrahydrofuran or dioxan; lower acid amides, such as for exmple acetamide or dimethylformamide, dimethylacetamide, dimethylsulphoxide, glycolmonomethyl ether or glycoldimethyl ether or diglycolmonomethyl ether or diglycoldimethyl ether. Water is particularly preferred for the purpose in question. Of the organic solvents, the lower alkanols, especially ethanol, and the propanols are preferred.

The conditioning agents and water-repellents according to the invention are prepared by kneading or stirring 80 to 99, preferably 95 to 99, parts by weight of a compound of the general formula I $$R-B-\underset{\underset{O}{\|}}{C}-NH-SO_2-X \qquad (I)$$

in which

R signifies alkyl with 10 to 30 carbon atoms,

B is one of the divalent radicals $$-\underset{\underset{R}{|}}{N}-,\ -\underset{\underset{R^1}{|}}{N}-\ \text{or}\ -NH-C_nH_{2n}-\underset{\underset{R^2}{|}}{N}-,$$

X is β-halogenalkyl or alkenyl with 2 to 4 carbon atoms each, $R^1$ and $R^2$ signify hydrogen or alkyl with 1 to 4 carbon atoms and n signifies 2, 3 or 4, with 1 to 20, preferably 1 to 5, parts by weight of an emulsifier consisting of 100–37.5 percent by weight of known non-ionic emulsifiers, 0–50 percent by weight of known anionic emulsifiers, 0–25 percent by weight of known fatliquors and 0–5 parts by weight of an epoxide of the formula II $$R^3-\underset{\underset{O}{\diagdown\ \diagup}}{CH}-CH_2 \qquad \text{(II)}$$

in which $R^3$ signifies alkyl or alkenyl with 15 to 40 carbon atoms, at temperatures of 20° to 90° C. until a homogeneous mass has been formed and possibly, by the addition of water or an organic solvent which is miscible with water it is adjusted to a content of 10 to 40 percent by weight of the compound of the general formula I.

The composition of the emulsifier used for this purpose can be adapted in the manner described above to the purpose of application envisaged for the product according to the invention to be produced. In auxiliary preparations according to the invention specially envisaged for the leather sector one leaves out the addition of the epoxide of the formula II, whereas in the case of the production of preparations according to the invention which are envisaged for use in the textile sector, an addition of 0.5 to 5 parts by weight, preferably 0.5 to 2 parts by weight, of the epoxide is carried out.

The application of the conditioning agents and water-repellents according to the invention is carried out in a known manner, such as is usual in the finishing or high-grade finishing of textiles and in leather treatment processes. Accordingly, for the achievement of the conditioning and water-repellency of textile materials containing cellulose or consisting of cellulose, aqueous treatment liquors are used which contain 5 to 50 g/liter of an active principle of the general formula I. Advantageously, this quantity of active principle is added to the aqueous treatment bath in the form of the auxiliary preparations according to the invention described above. This has the considerable advantage that the active principles of the formula I pass immediately on addition, into a fine emulsion or dispersion which are stable even for a long period of standing or under the conditions of use of the treatment bath. Because of the excellent compatibility of the active principles of the formula I contained in the auxiliaries according to the invention with other known auxiliaries and treatment agents for textiles and leather, the conditioning and water-proofing can also be carried out simultaneously with other post-treatment or improvement stages in a single bath. For this purpose it is possible for the auxiliary preparations according to the invention to be used also at the same time as dye liquors which contain anionic cellulose or leather dyestuffs as well as the dyeing aids belonging to them, such as retarders, levellers, dispersants, neutral salts as well as, where necessary, additives which determine the pH of the liquors. Surprisingly, it is also possible to employ the auxiliaries according to the invention in combination with known textile improving agents on the basis of aminoplast/formaldehyde precondensates which are used together with acid condensation catalysts or condensation catalysts which split off acid.

The textile materials containing cellulose or consisting of cellulose which have been conditioned and waterproofed using the auxiliary preparations according to the invention have an outstanding plushy and woolly handle and have very good water-repellent properties. Leather which has been treated according to the invention has a very soft, delicate surface with a pleasant feel and has a considerably reduced water absorption capacity and a strongly reduced dynamic water absorption as compared with untreated goods.

Of special importance also is the fact that the said advantageous effects of the treatment according to the invention are obtained both on vegetable tanned leather and also on chrome tanned leather, that they can be used with a similar good effect on velvet leather of different origin, for example on goat velvet leather and pig velvet leather, and the leather surfaces obtained show no staining but impart to the velvet a chamois type of handle and render it insensitive to hydrophilic dirt and spots which can result from aqueous colourless or coloured liquids, such as for example fruit juices, red wine, ink, blood etc. The effects which are obtained during the treatment according to the invention on textile materials containing cellulose or consisting of cellulose and on leather have a very good resistance to further stages in post-treatment, against water, aqueous detergent solutions and dry cleaning with organic solvents.

Besides the particularly advantageous effects of the post-treatment according to the invention the conditioning agents and water-repellents to be used according to the invention possess an outstanding storage capacity and stability in aqueous liquors. The post-treatment process according to the invention for the achievement of the conditioning and water-repellency of textile materials containing cellulose or consisting of cellulose and of leather as well as the auxiliary preparations according to the invention used for this process, accordingly, show a technically particularly advantageous combination of valuable properties and from this point of view are considerably superior to previously known processes and auxiliaries.

The active principles of the general formula I $$R-B-\underset{\underset{O}{\|}}{C}-NH-SO_2-X \qquad \text{(I)}$$

in which B signifies a divalent radical of the formula $>NR^1$ in which $R^1$ signifies hydrogen and R is a long-chained alkyl radical are known from German Patent Application 1 545 871 laid open to first public inspection. The compounds are used there for the production of tetrahydro-1,2,4-thiadiazin-3-one 1,1-dioxides. It is therefore not possible to find any reference in this publication to the present invention.

Sulphonylureas of the general formula I $$R-B-\underset{\underset{O}{\|}}{C}-NH-SO_2-X \qquad \text{(I)}$$

in which

R signifies alkyl or alkenyl with 10 to 30 carbon atoms

B is one of the divalent radicals $$-\underset{\underset{R}{|}}{N}-,\ -\underset{\underset{R^1}{|}}{N}-\ \text{or}\ -NH-C_nH_{2n}-\underset{\underset{R^2}{|}}{N}-$$

and

X is β-halogenoalkyl or alkenyl with 2 to 4 carbon atoms each, $R^1$ signifies alkyl with 1 to 4 carbon atoms, $R^2$ signifies hydrogen or alkyl with 1 to 4 carbon atoms and n signifies 2, 3 or 4, have hitherto not been described.

These new sulphonylureas which are employed as active principles for the production of the conditioning agents and water-repellents according to the invention also constitute a part of the object of the invention.

Such sulphonylureas of the formula I in which R signifies alkyl with 12 to 22 carbon atoms and, particularly, coconut oil alkyl, tallow alkyl or oleyl, are particularly valuable and stearyl is most preferred.

Furthermore, these sulphonylureas of the formula I according to the invention are preferred in which B is one of the divalent radicals $$-\underset{\underset{R}{|}}{N}-\ \text{or}\ -\underset{\underset{R^1}{|}}{N}-,$$

and also those in which X signifies β-chloroalkyl with 2 to 4 carbon atoms, such as the β-chloroethyl-, β-chloropropyl- or β-chlorobutyl group.

The preparation of the sulphonylureas of the general formula $$R-B-\underset{\underset{O}{\|}}{C}-NH-SO_2-X \qquad (I)$$

in which

R signifies alkyl or alkenyl with 10 to 30 carbon atoms

B is one of the divalent radicals $$-\underset{\underset{R}{|}}{N}-,\ -\underset{\underset{R^1}{|}}{N}-$$

or $$-NH-C_nH_{2n}-\underset{\underset{R^2}{|}}{N}-$$

X is β-halogenoalkyl or alkenyl with 2 to 4 carbon atoms each, $R^1$ signifies alkyl with 1 to 4 carbon atoms, $R^2$ signifies hydrogen or alkyl with 1 to 4 carbon atoms and n signifies 2, 3 or 4, is carried out by reacting a β-halogenoalkyl-sulfonyl-isocyanate with 2 to 4 carbon atoms in the alkyl radical $$O=C=N-SO_2-X^1$$

in which $X^1$ is β-halogenoalkyl with 2 to 4 carbon atoms with an amine of the formula $$R-B-H$$

in which B signifies one of the divalent radicals $$-\underset{\underset{R}{|}}{N}-,\ -\underset{\underset{R^1}{|}}{N}-\ \text{or}\ -NH-C_nH_{2n}-\underset{\underset{R^2}{|}}{N}-,$$

R signifies alkyl or alkenyl having 10–30 carbon atoms, $R^1$ signifies alkyl with 1 to 4 carbon atoms, $R^2$ signifies hydrogen or alkyl with 1 to 4 carbon atoms and n signifies 2, 3 or 4, in a molar ratio of about 1:1 in an aprotic organic solvent at temperatures between 20° C. and 110° C., preferably between 30° C. and the boiling point of the organic solvent employed, the reaction product is isolated in the usual manner and, if a compound of the formula I is to be produced in which X signifies alkenyl, it is then treated in a known manner with aqueous alkali.

Preferred sulphonylureas according to the invention are obtained if according to the process stated above the β-halogenoalkyl-sulfonyl-isocyanate with 2 to 4 carbon atoms in the alkyl radical is reacted with an amine of the formula $$R-B-H$$

in which

R signifies alkyl or alkenyl with 12 to 22 carbon atoms and, especially, coconut oil alkyl, tallow alkyl or oleyl and stearyl is most preferred.

Likewise preferred sulphonyl ureas according to the invention are obtained if the β-halogenoalkyl-sulfonyl-isocyanate with 2 to 4 carbon atoms in the alkyl radical is reacted with an amine of the formula $$R-B-H$$

in which

B is one of the divalent radicals $$-\underset{\underset{R}{|}}{N}-\ \text{or}\ -\underset{\underset{R^1}{|}}{N}-.$$

Preferably, one uses β-halogenoalkyl-sulfonyl-isocyanate with 2 to 4 carbon atoms in the alkyl radical as the β-chloroalkyl-sulfonyl-isocyanate with 2 to 4 carbon atoms in the alkyl radical.

Aprotic organic solvents in which the reaction of β-halogen ethyl-sulphonyl isocyanates can be carried out with the amines of the formula RBH are for example aliphatic hydrocarbons with up to 10, preferably 7, carbon atoms, especially the representatives of this series which are liquid at normal temperature, as well as mixtures of these hydrocarbons which are liquid at normal temperature, as well as mixtures of these hydrocarbons which are liquid at normal temperature, advantageously those with boiling points between 50° and 180° C., preferably between 50° and 100° C., liquid halogenated hydrocarbons with up to 6 carbon atoms and up to 4 chlorine atoms, benzene, alkylbenzenes with 1 to 3 alkyl radicals each with 1 to 3 carbon atoms and halogenbenzenes, especially chlorobenzenes with 1 to 3 halogen atoms, especially chlorine atoms.

Examples of solvents which can be used for the process according to the invention are pentane, hexane, heptane, octane, nonane, decane, petrol ether, ligroin and naphtha, ethylene chloride, chloroform, dichlorethane, trichlorethylene, perchlorethylene, benzene, toluene, ortho, meta and para-xylene, ethylbenzene, diethylbenzene, isopropylbenzene, monochlorobenzene, monobromobenzene, orthodichlorobenzene, metadichlorobenzene, ortho, meta or para-chlorotoluene.

The water-immiscible organic solvents which are particularly suitable for carrying out the process according to the invention are the aliphatic chlorinated hydrocarbons, especially dichlorethane, trichlorethylene, perchlorethylene and the aromatic hydrocarbons, especially benzene, toluene, ortho, meta and paraxylene (also in the form of their technical mixtures), monochlorobenzene and orthodichlorobenzene. Monochlorobenzene is particularly preferred.

If in order to accelerate the reaction it is desired to carry out the process at temperatures above the boiling point of the organic solvent used, for example carrying out the reaction at 100° C. in benzene, it is possible to operate in a vessel which is sealed and pressure-resistant.

In the production of the sulphonylureas according to the invention it is also possible to use an excess of one of the reactants. Also in this case the chemical reaction takes place in the molar proportion of 1:1, but, as is known, when one increases the concentration of one of the reactants the reaction speed is regularly increased. A disadvantage of this method is to be found in the fact that the excess used probably has to be removed from the reaction product.

It is particularly advantageous to carry out the reaction by dissolving the reaction components, possibly separately, in the desired organic solvent at temperatures between 20° and 50° C., preferably 30° and 40° C., and gradually combining them and bringing the reaction to a conclusion after the heat generated has stopped by heating the reaction mixture to boiling point.

The isolation of the reaction products obtained can be carried out in a known manner, for example by distilling off the solvent and, possibly, if it is necessary for analytical purposes, to purify the reaction product obtained, for example by recrystallisation.

In an entirely analogous manner, as has been described for the new sulphonylureas according to the invention it is also possible to produce the sulphonylureas known from DOS No. 1,545,871 which also can be contained as active principles in the conditioning agents and water-repellents according to the invention.

The treatment of textile materials with the treatment floats containing the conditioning agents and water-repellents according to the invention can be carried out in the usual manner, for example by impregnating on a two-roll or three-roll foulard, squeezing out and then drying or condensing at temperatures of 90° to 150° C. The application of the conditioning liquors and water-repellents according to the invention to leather is carried out as is usual in the leather industry, at temperatures between 15° and 70° C., preferably during continuous drumming for 15 to 60 minutes in a rotating drum, using 2 to 15% of the agent according to the invention in 20 to 1000% of aqueous liquor, reckoned on the weight of the leather. However, it is also possible for the treatment to be carried out be spraying the leather with the treatment liquor, which, in addition to the conditioning agents and water-repellents according to the invention, can contain further auxiliaries which are necessary for leather dressing, such as for example fatliquors or lacquers and followed by the fixing of the reactive substance according to the invention by a heat treatment at 50° to 120° C., possibly under pressure, for example in an ironing press.

The impregnation of leather can be carried out very easily with the said sulphoureas from hot or cold aqueous solutions also in the foulards which are known in the textile industry and which in more recent times have also been introduced into the leather industry, up to now mainly for dyeing.

One uses between 20 and 300 g/liter. After the impregnation and squeezing off the leather is dried and, as described in the case of spray impregnation, is fixed hot at 50° to 120° C.

In exceptional cases, especially when one is dealing with already conditioned leather articles, it is possible to apply the aqueous solution of the water-repellent also by brushing on by hand or by means of brushing machines, the penetration of the dispersion into the interior of the leather being assisted by the addition of 0 to 50 percent of a so-called penetrator, such as for example butyldiglycol, butylpentaglycol, dimethylformamide, dimethylsuphoxide etc. After drying, in the usual manner it is hot-fixed at 50° to 120° C. and the suede which has been temporarily stuck down is erected again by a hard brush in the dry state.

The examples of execution which follow illustrate the production and use of the conditioning agents and water-repellents according to the invention, and also the production of the new sulphonylureas contained as active principles in the auxiliaries according to the invention. The statements of parts given in the present application are parts by weight; the percentages indicate percent by weight.

EXAMPLE 1

81.3 g (0.3 moles) of octadecylamine is dissolved at 40° C. in 280 ml of toluene. To this solution one adds drop by drop at 40° C. over a period of 75 minutes 51.9 g (0.306 moles) of β-chorethylsulphonyl isocyanate. Then the reaction is brought to an end by boiling for 1 hour under a reflux and it is stirred for a further 2 hours to a temperature of 40° to 50° C. Then the toluene is distilled off in vacuo. One obtains in this way 126.5 g, approximately 96% of theory, of crude N-octadecyl-N′ β-chlorethylsulphonyl urea with a melting point of 89° to 90° C.

Analysis: $C_{21}H_{43}ClSN_2O_3$ (438.5)

Calculated: N 6.4%; Cl 8.2%; S 7.4%; found: N 6.3%; Cl 8.4%; S 7.6%.

Likewise it is possible to react 55.5 g (0.3 moles) of laurylamine or 72.3 g (0.3 moles) of hexadecylamine with 51.9 g (0.306 moles) of β-chlorethylsulphonyl isocyanate under the reaction conditions described to give N-lauryl-N′-β-chlorethylsulphonyl urea or N-hexadecyl-N′-β-chlorethylsulphonyl urea. N-lauryl-N′-β-chlorethylsulphonylurea:

$C_{15}H_{31}ClSN_2O_3$ (354.5) M.P. 79°–80° C.

Calculated: N 7.8%; S 9.0%; Cl 10.0%; found: N 7.3%; S 8.8%; Cl 9.6%.

N-hexadecyl-N′-β-chlorethylsulphonylurea:

$C_{19}H_{39}ClSN_2O_3$ (410.5) M.P. 83°–84° C.

Calculated: N 6.8%; Cl 8.6%; S 7.8%; found: N 6.4%; Cl 8.2%; S 7.1%.

The compounds prepared according to the process described above are converted in the following manner into an auxiliary preparation according to the invention.

200 g of N-octadecyl-N'-β-chlorethylsulphonyl-urea is molten, whilst stirring, with 50 g of the reaction product of 4-nonylphenol and 23 moles of ethylene oxide at 65° to 75° C. Then there is added slowly to this homogeneous melt 750 g of water at 70° to 80° C., it is stirred for 1 hour at 70° to 80° C. and the emulsion obtained is finished by stirring until it cools to room temperature. Instead of the 750 ml of water it is also possible to use 750 ml of a mixture of ethanol/water 1:1 or 750 ml of dimethoxyethane.

Just as good an emulsion is obtained if instead of the reaction product of 4-nonylphenol with 23 moles of ethylene oxide one uses the same quantity of the reaction product of 2,4,6-tributylphenol with 30 moles of ethylene oxide.

It is also possible to work with the reaction product of 2-benzyl-2'-hydroxydiphenyl with 15 moles of ethylene oxide.

An emulsion with an extremely high stability and outstanding technical properties when used is obtained if 200 g of N-octadecyl-N'-β-chlorethylsulphonyl urea with a melting point of 89° to 90° C. in the form of the crude product produced in the manner described above is molten homogeneously at 65° to 70° C. with 50 g of a reaction product of lanolin with 20 moles of ethylene oxide, 750 g of water is added slowly to this melt at 70° to 80° and it is cooled to room temperature whilst stirring.

EXAMPLE 2

195 g (1 mole) of coconut fat amine is dissolved at a temperature of 40° to 50° C. in 500 ml of $CHCl_3$ and 177.9 g (1.05 moles) of β-chlorethylsulphonyl isocyanate is added to this solution drop by drop. By heating for 1 hour to 50° to 60° C. the reaction is brought to an end. The chloroform is distilled off from the crude product which is obtained. The yield amounts to 360 g or 98.7% of theory. M.P. 75° to 80° C.

$$C_{12.71}H_{26.42}-NH-\underset{\underset{O}{\|}}{C}-NH-SO_2-CH_2-CH_2Cl \qquad \text{(mole 364.5)}$$

Analysis: calculated: N 7.68%; Cl 9.73%; S 8.78%; found: N 7.5%; Cl 8.9%; S 8.4%.

One can obtain the analogous compound if instead of coconut fat amine one reacts 280 g (1 mole) of oleylamine or 270 g (1 mole) of tallow fat amine with 177.9 g (1.05 moles) of β-chlorethylsulphonyl isocyanate.

$$C_{18.79}H_{38.57}-NH-\underset{\underset{O}{\|}}{C}-NH-SO_2-CH_2-CH_2Cl \qquad \text{(mole 449.5)}$$

calculated: N 6.23%; Cl 7.90%; S 7.12%; found: N 5.8%; Cl 7.3%; S 6.7%.

$$C_{18.07}H_{37.07}-NH-\underset{\underset{O}{\|}}{C}-NH-SO_2-CH_2-CH_2Cl \qquad \text{(mole 439.5)}$$

calculated: N 6.37%; Cl 8.07%; S 7.28%; found: N 6.19%; Cl 7.80%; S 6.90%.

From these compounds it is possible to produce auxiliary preparations according to the invention in the following manner, which are suitable with special advantages for the conditioning and water-proofing of textile materials:

200 g of N-tallow fat alkyl-N'-β-chlorethylsulphonyl urea is molten whilst stirring with 40 g of the reaction product of 1 mole of oleyl alcohol with 23 moles of ethylene oxide and 10 g of an epoxydised $C_{30}$-α-olefin at a temperature of 70° to 80° C. Into this homogeneous melt there is stirred 750 ml of water at 80° to 90° C. After a subsequent stirring time of 2 hours, the emulsion obtained is stirred until it cools to room temperature.

One obtains emulsions which are practically as good if instead of the reaction product of oleyl alcohol with 23 moles of ethylene oxide one uses the same quantity of the reaction product of octadecyl alcohol with 30 moles of ethylene oxide.

EXAMPLE 3

141.5 g (0.5 moles) of N-methyl-octadecylamine is dissolved at 40°–50° C. in toluene and then to this solution one adds drop by drop 88.95 g (0.525 moles) of β-chloroethylsulphonyl isocyanate. After a subsequent stirring period of 2 hours at 80° to 90° C. the reaction is complete. By distilling off the toluene in vacuo one obtains 198.5 g or 93.4% of theory, of crude N-methyl-N-octadecyl-N'-β-chloroethylsulfonyl urea.

Analysis $C_{22}H_{45}N_2O_3SCl$ (452.5) M.P. 150°–160° C.

Calculated: N 6.2%; Cl 7.8%; S 7.1%; found: N 6.0%; Cl 7.7%; S 6.8%.

One obtains analogous reaction products by reacting 92.5 g (0.5 moles) of N-ethyl-decylamine or 120.5 g (0.5 moles) of N-n-butyl-dodecylamine with 88.95 g (0.525 moles) of β-chlorethyl-sulphonyl isocyanate.

By melting 100 g of the N-methyl-octadecyl-N'-β-chlorethylsulphonyl urea described above with 25 g of the reaction product of tallow fatty alcohol with 11 moles of ethylene oxide accompanied by vigorous agitation followed by the addition of 375 g of water at 70° to 80° C., one obtains an emulsion which is stable on storage and possesses good properties for technical use on textile material and on leather.

EXAMPLE 4

390.75 g (0.75 moles) of N-dioctadecylamine is dissolved in 1000 ml of ethylene chloride at 60° to 70° C. and there is added to it drop by drop at this temperature 127.1 g (0.75 moles) of β-chlorethyl-sulphenyl isocyanate dissolved in 150 ml of ethylene chloride, and the stirring is continued for 2 hours. By distilling off the ethylene chloride in vacuo one obtains 498.3 g which is approximately 96.2% of theory, of crude, N,N-dioctadecyl-N'-β-chlorethyl-sulphonyl urea.

M.P. 104°–106° C.

Analysis $C_{39}H_{79}ClN_2O_3S$ (690.5)

Calculated: N 4.05%; Cl 5.14%; S 4.52%; found: N 3.8%; Cl 4.9%; S 4.3%.

In the same way it is possible to react 348.75 g (0.75 moles) of N-di-hexadecylamine with 127.1 g (0.75 moles) of β-chlorethyl-sulphonyl isocyanate or 432.75 g (0.75 moles) of N-di-eicosylamine with 127.1 g (0.75 moles) of β-chlorethyl-sulphonyl isocyanate to give the corresponding sulphonyl ureas according to the invention.

100 g of the above-described N-di-octadecyl-N'-β-chlorethylsulphonylurea is molten with 25 g of the reaction product of 1 mol of coconut oil fatty alcohol and 25 moles of ethylene oxide or with 25 g of the reaction product of 1 mole of coconut oil fatty alcohol with 15 moles of ethylene oxide at a temperature of 80° to 85° C. and it is stirred until cool.

It is also possible to produce an equally good emulsion if one uses 25 g of the reaction product of 4-benzyl-2'-hydroxy-diphenyl or 2-benzyl-2'-hydroxydiphenyl in each case with 12 moles of ethylene oxide instead of the abovementioned reaction product of 1 mole of coconut oil fatty alcohol with 15 or 25 moles of ethylene oxide.

EXAMPLE 5

A cotton fabric of 125 g/m$^2$ is impregnated with a liquor of 25 g/liter of an auxiliary preparation according to the invention produced according to Example 1, it is squeezed out to a residual moisture content of 80% and is dried for eight minutes at 125° C.

The treated fabric has a pleasant soft handle and a good water repulsion. The improvement in the handle and the water-repellent effect obtained are resistant to washing.

EXAMPLE 6

A cotton/polyester mixed fabric of 65 parts of cotton/35 parts of polyester with a weight of 100 g or a cotton/polyamide mixed fabric with a proportion of 80/20 and a weight of 115 g are impregnated with a liquor which contains 25 g per liter of an auxiliary preparation according to the invention, which was produced in the following manner:

Whilst striing vigorously, 100 g of N-octadecyl-N'-$\beta$-chlorethyl-sulphonyl urea produced according to Example 1 is molten at 80° to 85° C. with 20 g of the reaction product of 1 mole of oleyl alcohol with 23 moles of ethylene oxide and 5 g of an epoxydised $C_{30}$-$\alpha$-olefin. Then 375 g of water at a temperature of 85° to 90° C. is stirred into this homogeneous melt and the finely-disposed stable emulsion is stirred until cool.

The fabrics impregnated with the auxiliary liquor are de-watered to 64% or 60% and dried at 8 minutes at 125° C. The textile fabrics treated in the manner described above show a pleasant soft handle. They show a good water repulsion. The effects obtained are resistant to washing.

EXAMPLE 7

The treating of a textile fabric as described in Example 5 is repeated, but this time 25 g per liter of the auxiliary according the invention prepared according to Example 3 is used and, in addition, there is used in the liquor, in addition, 80 g per liter of a dimethylol-dihydroxy-ethylene urea together with 10 g/liter of $MgCl_2 \cdot 6H_2O$.

The goods so treated, in addition to the advantageous properties brought about by the aminoplast finish also show a very pleasant soft handle and very good water-repellent properties. The effects achieved are extremely resistant to washing.

EXAMPLE 8

In the following Examples which illustrate the use of the auxiliary preparations according to the invention in the leather sector, the quantities used quoted in percentages relate to the dry weight of the leather. Statements of concentration in percentages refer to percentages by weight.

10 semichromed East Indian bastard clothing suede leathers with a dry weight of 2.6 kg are drummed for approximately 1 hour with 100% $H_2O$, 2% $NH_4OH$ and 0.1 to 0.2% of an anionic emulsifier. Then the skins are rinsed with water at 20° C. to 25° C. for 5 minutes and then drummed in a tanning drum with 100 to 200% of water, 1 to 2% of 25% ammonia and 10% of the auxiliary preparation according to the invention described in Example 1. After this period of time the quantity of water is increased to a total of 1000% and is heated to 60° to 70° C. In this bath the skins are dyed in the usual manner with anionic dyestuffs and acidified with formic acid, when the quantity of acid should not be less than 2%.

The skins are placed on a rack without rinsing for 24 hours and then dried at 60° to 70° C. and finally drummed for 3 to 4 hours.

The skins treated in this way show a silky smooth suede handle and have a good gloss effect.

Drops of water then applied do not penetrate into a leather which has been treated in this way within 4 hours as compared with a penetration time of 2 to 4 minutes in the case of an untreated skin. The dynamic water absorption using the disc method is reduced from 140 to 150% in the case of untreated skins to 40 to 50%.

Instructions for the determination of the dynamic water absorption of leather using the disc method:

For the determination comparable pieces of leather are always used, which have as far as possible been cut out side by side from one piece of leather.

In each case 3 leather discs of a diameter of 20 mm are punched out of the test sample.

The cut surfaces of the discs are provided with a nitro-cellulose lacquer, dried and each piece is weighed individually. Then the three leather samples are placed in a 500-ml shaking bottle which contains 250 ml of demineralised water at 20° C. and it is shaken for 15 minutes in a shaker (180 shaking frequencies per minute).

After shaking, the samples are mopped with filter paper and weighed.

Calculation of the percentage water absorption:

$$\%\ \text{water absorption} = (W_{wet} - W_{dry}) \cdot 100 / W_{dry}$$

$W_{wet}$ = weight of the wet leather
$W_{dry}$ = weight of the dry leather,

EXAMPLE 9

20 pre-dried chrome-tanned suede split sides with a dry weight of 60 kg are drummed in a tanning drum for about 1 hour with 1000% of water at 35° C., 2% of 25% ammonia and 0.2 to 0.4% of an anionic emulsifier. Then the skins are rinsed with water at 20° to 25° C. for approximately 5 minutes and then treated with 100 to 200% water, 1 to 2% of 25% ammonia and 5 to 10% of the auxiliary preparation according to the invention produced in accordance with Example 3. The pH of the liquor should be between pH 8 and 9 at the end of the treatment. After this time, according to the shade desired, 4 to 8% of dyestuff in powder form is added and after a dyeing period of 30 to 45 minutes the entire liquor is increased to 800 to 1000%, heated to 60° to 70° C. and after a running for a further 30 minutes is acidified in the usual manner with formic acid. The quantity of formic acid should be one-half of the amount of dyestuff employed.

The skins are stacked on a horse without rinsing for about 24 hours and then dried at 60° to 70° C. and finished in the usual manner.

The suede splits treated in this way have a soft chamois-like suede feel and have a good gloss.

The penetration time of drops of water applied onto it is improved from 5 to 10 minutes in the case of untreated leather up to 2 to 3 hours. The dynamic water absorption according to the disc method is reduced from 80–100% in the case of untreated skins to 30–50%. This water-repellent effect can be increased still further by a suitable water-repellent greasing afterwards.

EXAMPLE 10

10 sides of a moist chrome-tanned calf upper leather with a thickness of 0.8 to 1 mm are neutralised in the normal manner, re-tanned, dyed and greased to make them water-repellent.

As final treatment there is added to the dyeing and fat-liquoring bath which has been acidified and has a temperature of approximately 60° to 70° C. 1% to 3% of the auxiliary preparation according to the invention made according to Example 1. Prior to the addition, the auxiliary is diluted with water at 20° to 30° C. in a proportion of 1:3 and adjusted to a pH of 7.5 to 8.0 with 25% ammonia. The running time in the drum is approximately 10–20 minutes. After this period the skins are stacked on a horse without rinsing and finished in the usual manner.

By means of this final treatment which is to be regarded as top greasing with the reactive auxiliary according to the invention the skins receive a waxy warm surface handle with a water-repellent effect. The penetration time of drops of water applied onto it is increased from 1 to 2 minutes in the case of the untreated leather to 1 to 2 hours in the case of a leather treated in the manner described above.

EXAMPLE 11

Chrome-tanned dyed upholstery boxcalf prepared in the usual manner is dressed with a finish of termoplastic copolymerisates with inorganic or organic pigments. The application of the products on to the dried skins is carried out with a spray gun.

In order to obtain a good fastness to rubbing and to water these skins are given a final application of water-emulsifiable nitrocellulose lacquers.

In addition of 10 to 20 parts of the auxiliary is stirred into 100 parts of the emulsion lacquer, adjusted to a pH of 8.0 to 9.0 with 25% ammonia and then diluted with 100 parts of water at 20° C. to a concentration suitable for spraying. After 1 or 2 spray coats the skins are dried and ironed with a hydraulic ironing press at 70° to 80° C. and a pressure of 80 to 150 atmospheres gauge.

EXAMPLE 12

131.4 g (0.3 moles) of N-octadecyl-N'-β-chlorethyl-sulphonyl urea is dissolved in 700 ml of anhydrous dioxan and to this solution one adds slowly 24 g (0.6 moles) of NaOH dissolved in a mixture of 250 g of dioxan and 100 ml of $H_2O$. Then it is stored for 3 to 4 hours, neutralised with hydrochloric acid and the product isolated.

Yield: 110 g, i.e. approx. 91.2% of theory, of N-octadecyl-N'-vinyl-sulphonyl urea,

M.P.: 100°–109° C.

Analysis: $C_{21}H_{42}N_2O_3$ (402.5)

Calculated: N 6.9%; found N 6.3%; S 7.9%; S 7.3%.

In the same way it is possible to produce from 84.9 g (0.3 mole) of N-methyl-octadecylamine and 50.8 g (0.3 mole) of β-chlorethyl isocyanate first of all the N-methyl-octadecyl-N'-β-chlorethyl-sulphonyl urea and from this according to the above Example N-methyl-octadecyl-N'-vinyl-sulphonyl urea.

EXAMPLE 13

Normally dyed chrom suede split (4 kg rolled weight) with a thickness of 1.5 mm is treated in a continuous multipurposes Multimac machine (system of Staub+Co., Lederwerke Mönnedorf/Switzerland, manufacturer Trockentechnik GmbH, Homberg (Lower Rhein) at 60° C. with an impregnating liquor of 50 g per liter of the dispersion produced according to Example 3 and 20 g/liter of a 70% sulphonated fish oil (Derminol fat-liquor NBR, Hoechst AG). The throughput time of the leather was 10 seconds for a belt speed of 3 m per minute.

After passing through the fitted squeeze rollers the split had taken up 980 g of the dispersion.

The leather was dried in hot air in the usual manner at 80° C., pressed on an ironing press at 95° C. with a pressure of 30 atomospheres gauge for 5 seconds to carry out a heat fixing, and was buffed on a rotating buffing machine with emery paper of 220 grains.

One obtains a chamois type suede feel with a pleasant "writing-effect" and from which the water poured onto it runs away in drops.

EXAMPLE 14

On a made-up lady's handbag of semi-chrome East Indian bastard leather an aqueous solution of 50 g/liter of impregnating agent (according to Example 3) and 25 g/liter of butyldiglycol is applied by means of a brush. After drying at 50° C., the bag is exposed to a heat fixing at 100° for 60 minutes in a heating cabinet.

The suede which had been temporarily stuck down is brushed up with a wire brush. As a result of the impregnation treatment the bag obtains a greatly improved suede feel with a very good repellent effect on water dropped onto it.

With the products according to the invention of the compositions shown in the following table outstanding conditioning and water-repellent effects can also be obtained:

Table

Abbreviations: VSU=(Vinyl-sulphonyl)urea; CESU=(β-chlorethyl-sulphonyl)urea; EO=ethylene oxide

| Active principle | Emulsifier Component | %age | Epoxide | Solvent | a:b:c:d |
|---|---|---|---|---|---|
| N-octadecyl-N'-VSU or N,N-methyl-octadecyl-N'-VSU | Nonylphenol + 23 moles EO | 50 | — | water | 200:30:–:770 |
| | $CH_3(CH_2)_{16}—COOCH_2CH_2—SO_3^{\ominus}Na^{\oplus}$ | 20 | | | |
| | 2,4,6-tributylphenol + 23 moles of EO | 30 | | | |
| N-octadecyl-N'-VSU | Lanoline + 20 moles of EO | 65 | — | water | 150:20:–:830 |

Table -continued

Abbreviations: VSU=(Vinyl-sulphonyl)urea; CESU=(β-chlorethyl-sulphonyl)urea; EO=ethylene oxide

| Active principle | Emulsifier Component | %age | Epoxide | Solvent | a:b:c:d |
|---|---|---|---|---|---|
| or N,N-methyl-octadecyl-N'-VSU | $CH_3(CH_2)_{16}-CON(CH_3)-CH_2CH_2SO_3^{\ominus}Na^{\oplus}$ | 15 | | | |
| | 2,4,6-tributylphenol + 23 moles of EO | 20 | | | |
| N-octadecyl-N'-VSU | 4-nonylphenol + 23 moles EO | 20 | — | water | 350:55:–:595 |
| | $C_{18}H_{37}-SO_2-N(CH_3)-CH_2-CH_2-SO_3^{\ominus}Na^{\oplus}$ | 25 | | | |
| | 2,4,6-tributylphenol + 23 moles EO | 55 | | | |
| N,N-methyl-octadecyl-N'-CESU | Oleyl alcohol + 23 moles EO | 60 | — | water | 300:45:–:655 |
| or N,N-ethyl-decyl-N'-CESU or N,N-(n)-butyl-dodecyl-N'-CESU | Neatsfoot oil-sulphated-degree of sulphation 10% | 15 | | | |
| | $CH_3-(CH_2)_7-CH=CH-(CH_2)_7-CO-N(CH_3)-CH_2-CH_2-SO_3^{\ominus}Na^{\oplus}$ | 25 | | | |
| N,N-methyl-octadecyl-N'-CESU | Oleyl alcohol + 23 moles EO | 70 | — | water | 200:25:–:775 |
| or N,N-ethyl-decyl-N'-CESU or N,N-(n)-butyl-dodecyl-N'-CESU | $CH_3-(CH_2)_7-CH=CH-(CH_2)_7-CO-NH-CH_2-CH_2-SO_3^{\ominus}Na^{\oplus}$ | 30 | | | |
| N,N-methyl-octadecyl-N'-CESU | Coconut oil fatty alcohol + 25 moles EO | 60 | — | water | 400:65:–:535 |
| or N,N-ethyl-decyl-N'-CESU or N,N-(n)-butyl-dodecyl-N'-CESU | $CH_3-(CH_2)_{16}-COO-CH_2-CH_2-SO_3^{\ominus}Na^{\oplus}$ | 40 | | | |
| N,N'-methyl-octadecyl-N'-CESU | Tallow fatty alcohol + 11 moles EO | 85 | — | water | 200:25:–:775 |
| or N,N-ethyl-decyl-N'-CESU | $CH_3-CH_2-CH(SO_2Cl)-CH_2-CH_2-CH(SO_2Cl)-(CH_2)_6-CH_3$ | 10 | | | |
| or N,N-(n)-butyl-dodecyl-N'-CESU | $CH_3-CH_2-CH(SO_3^{\ominus}Na^{\oplus})-CH_2-CH_2-CH(SO_3^{\ominus}Na^{\oplus})-(CH_2)_6-CH_3$ | 5 | | | |
| N,N-methyl-octadecyl-N'-CESU | Tallow fatty alcohol + 11 moles EO | 85 | — | water | 180:30:–:790 |
| or N,N-ethyl-decyl-N'-CESU or N,N-(n)-butyl-dodecyl-N'-CESU | Montan wax | 5 | | | |
| | $CH_3-(CH_2)_{16}-CO-N(CH_3)-CH_2-CH_2-SO_3^{\ominus}Na^{\oplus}$ | 10 | | | |
| N,N-methyl-octadecyl-N'-CESU | Tallow fatty alcohol + 11 moles EO | 70 | — | water | 250:40:–:710 |
| or N,N-ethyl-decyl-N'-CESU or N,N-(n)-butyl-dodecyl-N'-CESU | Beeswax | 10 | | | |
| | $CH_3-(CH_2)_7-CH=CH-(CH_2)_7-CO-NH-CH_2-COO^{\ominus}Na^{\oplus}$ | 20 | | | |
| N-octadecyl-N'-CESU | 4-nonylphenol + 23 moles EO | 60 | — | water | 150:5:–:845 |
| or N-lauryl-N'-CESU or N-hexadecyl-N'-CESU | $CH_3-CH_2-CH(SO_2-NH-CH_2-CH_2-SO_3^{\ominus}Na^{\oplus})-(CH_2)_{9-12}-CH_3$ | 20 | | | |
| | 2,4,6-tributylphenol + 23 moles EO | 20 | | | |
| N-octadecyl-N'-Cesu or N-lauryl-N'-CESU | 4-nonylphenol + 18 moles EO | 50 | — | water | 125:25:–:850 |
| | $C_{18}H_{37}SO_2-N(CH_3)-CH_2-CH_2-SO_3^{\ominus}Na^{\oplus}$ | 20 | | | |
| or N-hexadecyl-N'-CESU | 2,4,6-tributylphenol + 23 moles EO | 30 | | | |
| N-octadecyl-N'-CESU or N-lauryl-N'-CESU | 4-nonylphenol + 18 moles EO | 90 | — | water | 300:55:–:645 |
| | 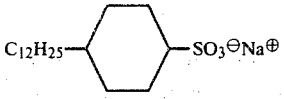 | 2 | | | |
| or N-hexadecyl-N'-CESU | 2,4,6-tributylphenol + 23 moles EO | 8 | | | |
| N-octadecyl-N'-CESU or N-lauryl-N' -CESU | 4-nonylphenol + 23 moles EO | 20 | — | water | 200:50:–:750 |
| | $CH_3-(CH_2)_{16}-COO-CH_2-CH_2-SO_3^{\ominus}Na^{\oplus}$ | 5 | | | |
| or N-hexadecyl-N'-CESU | 2,4,6-tributylphenol + 23 moles EO | 75 | | | |
| N-octadecyl-N'-CESU or N-lauryl-N'-CESU | 4-nonylphenol + 23 moles EO | 80 | — | water | 150:75:–:775 |
| | $CH_3-(CH_2)_7-CH=CH-(CH_2)_7-CO-NH-CH_2-$ | 10 | | | |

Table -continued

Abbreviations: VSU=(Vinyl-sulphonyl)urea; CESU=(β-chlorethyl-sulphonyl)urea; EO=ethylene oxide

| Active principle | Emulsifier Component | %age | Epoxide | Solvent | a:b:c:d |
|---|---|---|---|---|---|
| or N-hexadecyl-N'-CESU | $COO^{\ominus}Na^{\oplus}$ 2,4,6-tributylphenol + 23 moles EO | 10 | | | |
| N-octadecyl-N'-CESU | Lanoline + 23 moles EO | 75 | — | water | 250:25:–:725 |
| or N-lauryl-N'-CESU or | $CH_3-(CH_2)_{10}-CO-\underset{\underset{CH_3}{\vert}}{N}-CH_2-CH_2-SO_3^{\oplus}Na^{\ominus}$ | 20 | | | |
| N-hexadecyl-N'-CESU | 2,4,6-tributylphenol + moles EO | 5 | | | |

EXAMPLE 15

134.5 g (0.5 mol) of octadecylamine are dissolved in 350 ml. of toluene at 40° to 50° C. To this solution there are added dropwise 92.66 g. (0.505 mol) of 2-chloropropylsulfonylisocyanate at 40° to 50° C. over a period of 90 minutes. The reaction is finished by one-hour boiling under reflux conditions. Subsequently, the toluene is distilled off in vacuo.

Obtained are 218.5 g, which is 95.6% of theoretical, of N-octadecyl-N'-2-chloropropyl urea.

Analysis: $C_{22}H_{45}ClSO_3N_2$ (452.5)

M.P. 80° to 83° C.

| calculated: | N | Cl | S |
|---|---|---|---|
| | 6.2 % | 7.84 % | 7.07 % |
| found: | 5.6 % | 7.65 % | 6.80 % |

100 g of the resulting crude product are molten together with 25 g of the reaction product of 4-nonylphenol with 23 moles of ethylene oxide and a finely-dispersed paste of the product is prepared by adding 375 g of water at a temperature of 80° to 85° C.

In the same way it is possible to employ the reaction product of 2,4,6-tributylphenol with 50 mols of ethylene oxide in place of the above-specified reaction product of 4-nonyl phenol with 23 mols of ethylene oxide in order to obtain an emulsion of an equally good stability.

EXAMPLE 16

80.7 g (0.3 mol) of octadecylamine are dissolved in 300 ml of toluene at a temperature of 40° to 45° C. To this solution there are added dropwise 59.84 g (0.303 mol) of 2-chlorobutyl-sulfonyl-isocyanate at a temperature of between 50° and 60° C. and stirred for one hour under reflux conditions. The toluene is then distilled off in vacuo.

Obtained are 139 g, which is 98.3% of theoretical, of the crude product melting at 77° to 79° C. of N-octadecyl-N'-2-chlorobutyl urea.

Analysis: $C_{23}H_{47}ClSO_3N_2$ (466.5)

| | N | Cl | S |
|---|---|---|---|
| calculated: | 6.0 % | 7.6 % | 6.9 % |
| found: | 5.6 % | 7.7 % | 7.0 % |

100 g of the resulting crude product are reacted with 20 g of a reaction product of ricinoleic acid, molten together with 36 mols of ethylene oxide and stirred together with 380 g of warm water having a temperature of 80° to 85° C. by means of a turbine agitator. Obtained is a finely-dispersed paste possessed by the properties of the invention.

EXAMPLE 17

226.25 g (0.5 mol) of N-octadecyl-N'-β-chloropropylsulfonyl urea are dissolved in 1200 ml of dioxane and admixed drop by drop at 40° to 50° with 30 g (0.75 mol) of sodium hydroxide dissolved in a mixture of 350 g. dioxane and 140 ml of water. Thereafter the whole is stirred at 40° to 50° C. for three hours, neutralized with 2 n hydrochlorid acid and the resulting product isolated.

Yield obtained: 198 g, which is 95.2% of theoretical, of N-octadecyl-N'-propenyl-2-sulfonyl urea melting at 116° to 118° C.

Analysis: $C_{22}H_{44}SO_3N_2$ (416.0)

| | N | S |
|---|---|---|
| calculated: | 6.7 % | 7.7 % |
| found: | 6.4 % | 7.3 % |

In the same way, it is possible to produce under the above-described experimental conditions N-octadecyl-N'-butenyl-2-sulfonyl urea from 139.5 g (0.3 mol) of N-octadecyl-N'-β-chlorobutyl sulfonyl urea and 18 g (0.45 mol) sodium hydroxide dissolved in dioxane and water.

We claim:

1. Sulphonylurea of the formula $$R-B-\underset{\underset{O}{\Vert}}{C}-NH-SO_2-X$$

wherein R is alkyl or alkenyl having 10–30 carbon atoms; B is a member selected from the group comprising $$-\underset{\underset{R}{\vert}}{N}-,\ -\underset{\underset{R^1}{\vert}}{N}-\ \text{and}\ -NH-C_nH_{2n}-\underset{\underset{R^2}{\vert}}{N}-$$

wherein $R^1$ is alkyl having 1–4 carbon atoms, $R^2$ is hydrogen or alkyl having 1–4 carbon atoms and n is 2, 3 or 4;

and X is β-halogenoalkyl or alkenyl with 2 to 4 carbon atoms each.

2. Sulphonylurea according to claim 1 wherein R is stearyl, coconut oil alkyl, tallow alkyl or oleyl.

3. Sulphonylurea according to claim 2 wherein R is stearyl.

4. Sulphonylurea according to claim 2 wherein B is $$-\underset{\underset{R}{|}}{N}- \text{ or } -\underset{\underset{R^1}{|}}{N}-.$$

5. Sulphonylurea according to claim 2 wherein X is β-chloralkyl having 2 to 4 carbon atoms.

6. A conditioning and water-repellent composition for cellulose-containing textile materials and leather comprising (a) 80–99 parts by weight of a compound of the formula $$R-B-\underset{\underset{O}{\|}}{C}-NH-SO_2-X$$

wherein R is alkyl or alkenyl having 10 to 30 carbon atoms, B is $$-\underset{\underset{R}{|}}{N}-,\ -\underset{\underset{R^1}{|}}{N}- \text{ and } -NH-C_nH_{2n}-\underset{\underset{R^2}{|}}{N}-$$

wherein $R^1$ and $R^2$ are hydrogen or alkyl with 1 to 4 carbon atoms and n 2, 3, or 4; and X is β-halogenoalkyl or alkenyl with 2 to 4 carbon atoms each;

(b) 20–1 parts by weight of an emulsifier comprising 100–37.5% by weight of known non-ionic emulsifiers, 0–50% by weight of known anionic emulsifiers and 0–25% by weight of known fat-liquors;

(c) 0–5 parts by weight of an epoxide of the formula $$R^3-\underset{\underset{O}{\diagdown\diagup}}{CH}-CH_2$$

wherein $R^3$ is alkyl or alkenyl having 15–40 carbon atoms; and (d) water or water-miscible organic solvent in the amount of parts by weight defined by $$100 \cdot a/(10 \text{ to } 40)-(a+b+c)$$

wherein a, b and c are parts by weight of components a, b and c.

7. The conditioning and water-repellent composition according to claim 6 comprising 95–99 parts by weight of (a) and 5–1 parts by weight of (b).

8. The conditioning and water-repellent composition for textile use according to claim 6 comprising 0.5–5 parts by weight of (c) and wherein (b) contains 0% fat-liquor.

9. The conditioning and water-repellent composition for leather use according to claim 6 comprising 5–25% fat-liquor in (b) and zero parts of (c).

10. The conditioning and water-repellent composition according to claim 6 wherein R is alkyl or alkenyl having 12–22 carbon atoms.

11. The conditioning and water-repellent composition according to claim 10 wherein R is selected from the group consisting of stearyl, coconut oil alkyl, tallow alkyl and oleyl.

12. The conditioning and water-repellent composition according to claim 6 wherein B is $$-\underset{\underset{R}{|}}{N}- \text{ or } -\underset{\underset{R^1}{|}}{N}-.$$

13. The conditioning and water-repellent composition according to claim 6 wherein X is β-chloroalkyl having 2 to 4 carbon atoms.

14. The conditioning and water-repellent composition according to claim 6 wherein the emulsifier of (b) contains as the known non-ionic emulsifier a compound of the formula $$A-(OCH_2-\underset{\underset{R^4}{|}}{CH})-OH$$

wherein A is selected from the group consisting of branched or unbranched alkyl or alkenyl having 10 to 22 carbon atoms, alkylphenyl with a total of 6 to 12 carbon atoms in the alkyl radicals, branched or unbranched alkanoyl or alkenoyl having 10 to 22 carbon atoms, aralkyl having 7 to 15 carbon atoms, aralkylaryl having 13 to 25 carbon atoms, radicals of the wool grease components and acyloxyalkyl with a total of 10 to 30 carbon atoms;

$R^4$ is hydrogen, methyl or ethyl and n is an integer between 10 and 60.

15. The method of conditioning and rendering water-repellent cellulose-containing textiles and leather comprising applying to said textile or leather the composition according to claim 6.

16. In the method of conditioning and water-repellent treatment of cellulose-containing textiles and leather by treating said textiles or leather with an aqueous liquor containing a conditioning and water-repellent agent at temperatures of up to 110° C. wherein the improvement comprises said aqueous liquor containing as said agent 5 to 50 g/liter of a sulphonylurea of the formula $$R-B-\underset{\underset{O}{\|}}{C}-NH-SO_2-X$$

wherein R is alkyl or alkenyl having 10 to 30 carbon atoms $$B \text{ is } -\underset{\underset{R}{|}}{N}-,\ -\underset{\underset{R^1}{|}}{N}- \text{ or } -NH-C_nH_{2n}-\underset{\underset{R^2}{|}}{N}-$$

wherein $R^1$ and $R^2$ are hydrogen or alkyl having 1 to 4 carbon atoms and n is 2, 3 or 4; and X is β-halogenoalkyl or alkenyl with 2 to 4 carbon atoms each.

* * * * *